US012091067B2

(12) United States Patent
Bienek

(10) Patent No.: US 12,091,067 B2
(45) Date of Patent: Sep. 17, 2024

(54) OPERATING METHOD FOR VEHICLES WITH THE FORMING OR CONFIGURING OF A COMMUNICATIONS CONNECTION AFTER THE COUPLING PROCESS

(71) Applicant: SIEMENS MOBILITY GMBH, Munich (DE)

(72) Inventor: Frank Bienek, Wolfenbuettel (DE)

(73) Assignee: Siemens Mobility GmbH, Munich (DE)

( * ) Notice: Subject to any disclaimer, the term of this patent is extended or adjusted under 35 U.S.C. 154(b) by 912 days.

(21) Appl. No.: 17/261,948

(22) PCT Filed: Jun. 20, 2019

(86) PCT No.: PCT/EP2019/066314
§ 371 (c)(1),
(2) Date: Jan. 21, 2021

(87) PCT Pub. No.: WO2020/015948
PCT Pub. Date: Jan. 23, 2020

(65) Prior Publication Data

US 2021/0300446 A1 Sep. 30, 2021

(30) Foreign Application Priority Data

Jul. 20, 2018 (DE) ..... 10 2018 212 126.5

(51) Int. Cl.
*B61L 15/00* (2006.01)
*B61L 27/40* (2022.01)

(52) U.S. Cl.
CPC ..... *B61L 15/0072* (2013.01); *B61L 15/0027* (2013.01); *B61L 15/0036* (2013.01);
(Continued)

(58) Field of Classification Search
CPC ..... B61L 15/0072; B61L 15/0027; B61L 15/0036; B61L 15/0054; B61L 27/40; B61L 2205/02; B61L 15/0045; B61L 15/0058
(Continued)

(56) References Cited

U.S. PATENT DOCUMENTS 7,845,504 B2 * 12/2010 Davenport ..... B61L 15/02 246/1 C
11,051,188 B2 * 6/2021 Hutchins ..... B61L 27/16
(Continued)

FOREIGN PATENT DOCUMENTS

CN 101841448 A 9/2010
CN 103476662 A 12/2013
(Continued)

OTHER PUBLICATIONS

Zou Rui-ming et al.: "Coupling stability of couplers between locomotive and vehicle", Journal of Traffic and TransportationEngineering, vol. 16, No. 6, Dec. 2016—English abstract.

*Primary Examiner* — Zachary L Kuhfuss
(74) *Attorney, Agent, or Firm* — Laurence A. Greenberg; Werner H. Stemer; Ralph E. Locher

(57) ABSTRACT

A method operates a first and a second vehicle. Accordingly, on the vehicle side, it is checked whether a new coupling with another vehicle has occurred, and after establishing a new coupling, a respective configuration signal signaling the coupling status is transmitted to a track-side switching unit. If there is a configuration signal of the first vehicle and a configuration signal of the second vehicle, a communications connection is established between the two vehicles via the track-side switching unit or an already existing communications connection between the two vehicles is reconfigured.

15 Claims, 6 Drawing Sheets

(52) U.S. Cl.
CPC ..... *B61L 15/0054* (2013.01); *B61L 27/40* (2022.01); *B61L 2205/02* (2013.01)

(58) Field of Classification Search
USPC ..... 701/19, 20
See application file for complete search history.

(56) References Cited

U.S. PATENT DOCUMENTS

| | | | | |
|---|---|---|---|---|
| 11,697,443 | B2 * | 7/2023 | Bonnes | G01S 19/14 246/122 R |
| 11,711,707 | B2 * | 7/2023 | Hutchins | B61L 15/0081 455/67.7 |
| 2007/0145196 | A1 | 6/2007 | Davenport et al. | |
| 2010/0241295 | A1 * | 9/2010 | Cooper | B60T 17/228 701/19 |
| 2011/0118914 | A1 * | 5/2011 | Brooks | B61L 15/0072 701/19 |
| 2011/0270475 | A1 * | 11/2011 | Brand | B61L 15/0027 701/19 |
| 2014/0041011 | A1 | 2/2014 | Beyer et al. | |
| 2014/0058623 | A1 * | 2/2014 | Kraeling | H04L 12/40 701/1 |
| 2014/0129060 | A1 * | 5/2014 | Cooper | G07C 5/008 701/19 |
| 2014/0129109 | A1 * | 5/2014 | Meyer | B61L 15/0081 701/82 |
| 2015/0200712 | A1 * | 7/2015 | Cooper | H04L 12/40169 375/257 |
| 2015/0360700 | A1 * | 12/2015 | Cooper | B61C 17/12 701/2 |
| 2016/0119799 | A1 * | 4/2016 | Hutchins | H04W 24/04 455/67.7 |
| 2016/0272228 | A1 * | 9/2016 | LeFebvre | H04L 67/12 |
| 2016/0359741 | A1 | 12/2016 | Cooper et al. | |
| 2017/0090473 | A1 | 3/2017 | Cooper et al. | |
| 2018/0159936 | A1 * | 6/2018 | Kirschner | B61L 27/70 |
| 2018/0319414 | A1 * | 11/2018 | Lefebvre | B61L 25/025 |
| 2019/0077430 | A1 * | 3/2019 | Katayama | B61L 15/0072 |
| 2019/0271991 | A1 * | 9/2019 | Dulmage | G08G 1/22 |
| 2020/0164906 | A1 * | 5/2020 | Lohneis | B61L 15/0072 |
| 2021/0289373 | A1 * | 9/2021 | Hutchins | B61L 15/0081 |
| 2022/0089202 | A1 * | 3/2022 | Gorman | B61G 3/00 |
| 2022/0204061 | A1 * | 6/2022 | Woo | B61L 23/042 |

FOREIGN PATENT DOCUMENTS

| | | | | |
|---|---|---|---|---|
| CN | 105539513 | A | 5/2016 | |
| CN | 107685743 | A | 2/2018 | |
| CN | 107685749 | A | 2/2018 | |
| CN | 108146471 | A | 6/2018 | |
| CN | 108216302 | A | 6/2018 | |
| DE | 102007040165 | A1 | 2/2009 | |
| DE | 102011082656 | A1 | 3/2013 | |
| DE | 102012009114 | A1 | 11/2013 | |
| DE | 102017113213 | A1 | 12/2018 | |
| EP | 2000387 | A2 | 12/2008 | |
| WO | WO-2004074067 | A1 * | 9/2004 | B60T 13/665 |
| WO | 2015150313 | A1 | 10/2015 | |
| WO | WO 2016191711 | A1 | 12/2016 | |

* cited by examiner

OPERATING METHOD FOR VEHICLES WITH THE FORMING OR CONFIGURING OF A COMMUNICATIONS CONNECTION AFTER THE COUPLING PROCESS

BACKGROUND OF THE INVENTION

Field of the Invention

The invention relates to a method for operating two vehicles.

The publication US 2016/0359741 A1 discloses a method for transmitting data between coupled vehicles of a vehicle consist. In the already known method, the data is transmitted via the intermediary of a wayside switching device.

SUMMARY OF THE INVENTION

The object underlying the invention is to specify a particularly simple and reliable method for establishing communication links between vehicles that can be coupled together.

According to the invention, this object is achieved by a method having the features as claimed in the independent claim. Advantageous embodiments of the method according to the invention are set forth in sub-claim.

According to the invention, it is provided that a check is performed on board the vehicle in each case to ascertain whether a new coupling to another vehicle has taken place, and once a new coupling has been detected, a configuration signal indicating the coupling state is transmitted to a wayside switching device and, if a configuration signal of a first vehicle and a configuration signal of a second vehicle are present, a communication link is established between the two vehicles with the inclusion of the wayside switching device, or an existing communication link between the two vehicles is reconfigured.

An essential advantage of the method according to the invention is that a communication link can be established or an existing communication link can be reconfigured in an automated manner as soon as a new coupling between vehicles is detected. According to the invention, the establishment of communication links is thus combined with the detection of a mechanical coupling state between the vehicles.

It is considered advantageous if the establishment or reconfiguration of the communication link is only carried out if the two configuration signals are received within a specified time period.

In a particularly preferred embodiment of the method, it is provided that the first vehicle, after detection of coupling, sends a first configuration signal containing route information relating to the first vehicle and/or a code identifying the first vehicle to the wayside switching device, the second vehicle, after detection of coupling, transmits a second configuration signal containing route information relating to the second vehicle and/or a code identifying the second vehicle to the wayside switching device, and a check is performed by the first and/or second vehicle and/or wayside as to whether coupling of the two vehicles is plausible.

In the case of the latter variant, it is particularly advantageous if the communication link between the two vehicles is only established by the wayside switching device if the vehicle identification codes indicate that the vehicles are vehicles to be coupled or capable of being coupled together according to a predefined data set and/or the route information of the two vehicles indicates that they have the same destination or will at least be traveling over a common route section.

In addition, it is considered advantageous for each vehicle to check whether an existing coupling to the respective other vehicle has been released and, after uncoupling has been detected, for the communication link between the two vehicles to be cleared down by the vehicle or by the wayside switching device.

With regard to detection of the respective coupling state, it is considered advantageous if the checking and detection of the coupled state is performed by means of a sensor device of the first vehicle and a sensor device of the second vehicle, on detecting the coupled state, the sensor device of the first vehicle switches from a first sensor status indicating an uncoupled state to a second sensor status indicating a coupled state, and once the switchover from the first sensor status to the second sensor status has been detected, a communication device of the first vehicle connected to the sensor device of the first vehicle sends its configuration signal to the wayside switching device, and, on detecting the coupled state, the sensor device of the second vehicle switches from a first sensor status indicating an uncoupled state to a second sensor status indicating a coupled state, and once the switchover from the first sensor status to the second sensor status has been detected, a communication device of the second vehicle connected to the sensor device of the second vehicle transmits its configuration signal to the wayside switching device.

The coupling status can be detected particularly easily and reliably by means of switching contacts; accordingly, it is considered advantageous if the sensor device of the first vehicle and/or the sensor device of the second vehicle is constituted by an electrical switching contact or has an electrical switching contact which has a different switching state, i.e. contact position, in the coupled state of an associated coupling of the vehicle compared to the uncoupled state, thereby indicating the respective coupling state.

Alternatively or in addition, it can be advantageously provided that the sensor device of the first vehicle and/or the sensor device of the second vehicle is constituted by a signal sensor or has a signal sensor which detects an electrical or optical signal connection present in the coupled state of the vehicles and, in the event of such detection, generates a coupling signal indicating the coupled state of the vehicles.

At least one of the two vehicles is preferably a vehicle powered by one or a plurality of drives. With particular preference, both vehicles are powered by one or a plurality of drives.

It can also be advantageously provided that at least one of the two vehicles is multi-section and consists of two or more individual vehicles, powered or non-powered, connected to each other.

The vehicles are preferably rail vehicles.

The invention also relates to a vehicle for operating a communication link with another vehicle. With respect to such a vehicle it is inventively provided that the vehicle has a coupling device for establishing a coupled state with the other vehicle, the vehicle has a sensor device which is suitable for determining whether the coupling device is in a coupled or uncoupled state, and the vehicle has a communication device connected to the sensor device which, when it detects a transition from the uncoupled state to the coupled state, transmits a configuration signal indicating the coupled state to a wayside switching device.

With regard to the advantages of the vehicle according to the invention, the above statements in connection with the method according to the invention are incorporated by reference herein.

The sensor device of the vehicle is preferably constituted by an electrical switching contact or preferably has an electrical switching contact which, in the coupled state of an associated coupling of the vehicle, has a different switching state or contact position compared to the uncoupled state, thereby indicating the respective coupling state.

The invention also relates to a line system comprising a wayside switching device which can communicate with vehicles running on the line system.

With regard to such a line system, it is provided according to the invention that the wayside switching device is designed such that, on receiving a first configuration signal indicating the coupled state of a first vehicle with another vehicle, and on receiving a second configuration signal indicating the coupled state of a second vehicle with another vehicle, it establishes communications between two vehicles or reconfigures an already existing communication link between the two vehicles.

In respect of the advantages of the line system according to the invention, the above statements in connection with the method according to the invention are incorporated by reference herein.

The wayside switching device is preferably designed such that it only interconnects the two vehicles if the first and second configuration signals reach it within a specified period of time.

The wayside switching device preferably has two or more wayside access devices which are interconnected and each capable of communicating with one or more vehicles and suitable for operating the communication link between two vehicles with the inclusion of two or more wayside access devices.

On receiving two configuration signals, the wayside switching device preferably checks whether it is plausible for the two vehicles sending the configuration signals to be coupled.

The wayside switching device is preferably designed or configured in such a way that it only establishes the communication link between the two vehicles if vehicle identification codes indicate that the vehicles are vehicles to be coupled or capable of being coupled to one other according to a predefined data set, and/or route information of the two vehicles indicates that they have the same destination or will at least be traveling over a common route section.

The wayside switching device is preferably designed or configured such that it clears down the communication link if at least one of the two vehicles indicates decoupling of the vehicles.

The invention will now be explained in more detail with reference to exemplary embodiments.

DETAILED DESCRIPTION OF THE INVENTION

Figure 1:
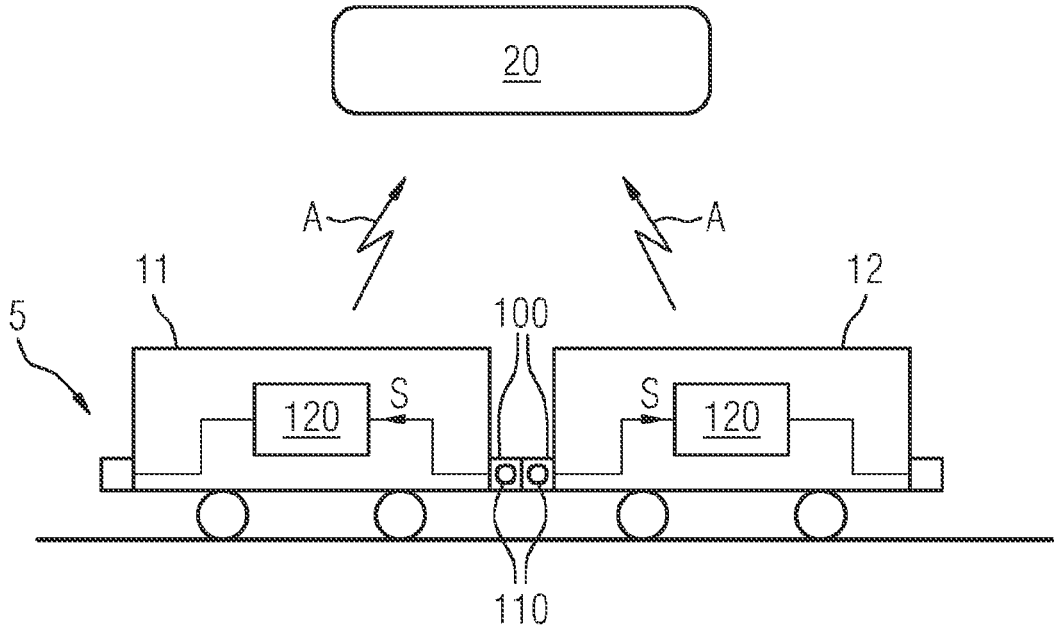
FIG. 1 shows an exemplary embodiment of an inventive line system used by two vehicles and with reference to which an exemplary embodiment of the method according to the invention will be explained.

In the figures, the same reference characters are always used for identical or comparable components.

FIG. 1 shows a line system 5 which is preferably a railroad track system. In the drawing in FIG. 1, the line system 5 is used by two vehicles labelled with reference characters 11 and 12. The vehicles 11 and 12 are rail vehicles.

The two vehicles 11 and 12 each have a coupling device 100, a sensor device 110 and a communication device 120. In the following, it is assumed by way of example that the two vehicles 11 and 12 are identical in terms of the coupling device 100, the sensor device 110 and the communication device 120; explanations/statements relating to the vehicle 11 thus apply accordingly to vehicle 12, and vice versa.

The coupling devices 100 allow a mechanical connection between the vehicles 11 and 12 so that, when coupled together, they form a vehicle consist or more specifically, in FIG. 1, a railroad train.

On detecting a coupled state, the sensor devices 110 of the two vehicles 11 and 12 are each designed to switch from a first sensor status indicating an uncoupled state to a second sensor status indicating a coupled state. By means of a sensor signal S, the respective sensor status of the sensor device 110 is read by the communication device 120 which therefore knows the coupling state of the coupling 100 of the respective vehicle at any time.

The line system 5 is also equipped with a wayside switching device 20 which can communicate with each of the two vehicles 11 and 12 or rather with their communication devices 120, e.g. by radio. The radio link between the switching device 20 and the vehicles 11 and 12 can be e.g. WLAN-, GSM- or LTE-based.

The vehicles 11 and 12 and the wayside switching device 20 preferably interoperate as follows:

Once the two vehicles 11 and 12 have been coupled together as shown in FIG. 1, the sensor devices 110 of the two vehicles will each switch from their first sensor status to their second sensor status and transmit a corresponding sensor signal S to their associated communication device 120.

On receiving the information that a coupled state now obtains, the communication devices 120 of the two vehicles 11 and 12 will each send a configuration signal A to the wayside switching device 20, informing said wayside switching device 20 that coupling to another vehicle has taken place.

When the corresponding configuration signal A of the vehicle 11 and the configuration signal A of the vehicle 12 are present, the wayside switching device 20 will establish a communication link 200 (cf. FIG. 2) provided that no communication link via the switching device 20 previously existed between the two vehicles 11 and 12.

Figure 2:
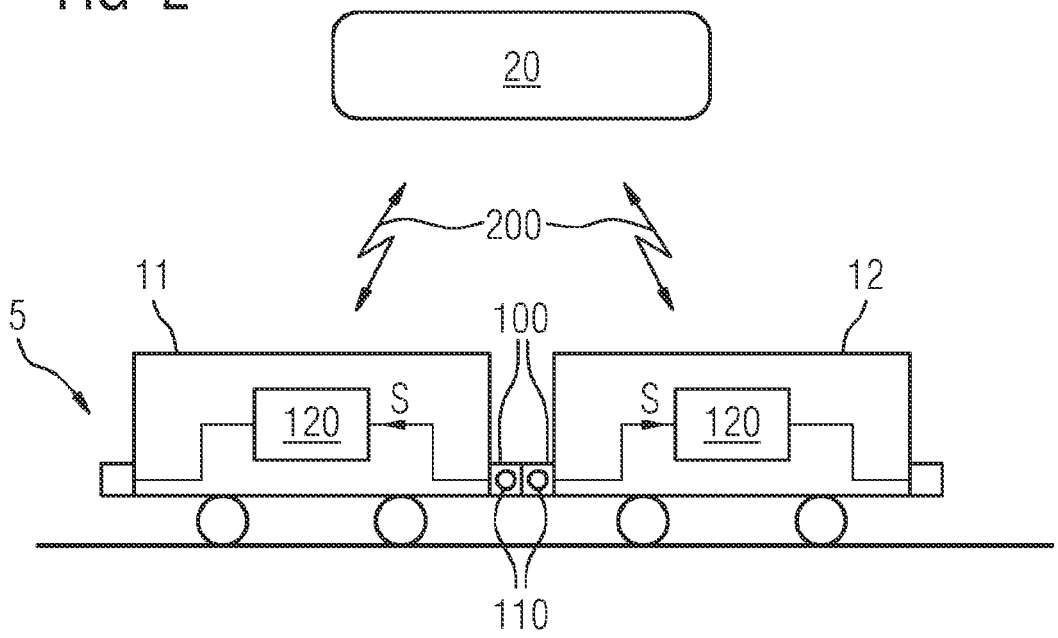
FIG. 2 shows the line system according to FIG. 1 after a communication link has been established between the two vehicles.

FIG. 2 shows the line system 5 as shown in FIG. 1 after coupling of the two vehicles 11 and 12. The switching device 20 has established said communication link 200 between the communication devices 120 of the two vehicles 11 and 12 so that they can now communicate with one other with the inclusion, i.e. via the intermediary, of the switching device 20.

If a communication link already existed prior to the coupling, it is preferable for it to be reconfigured. Reconfiguration of an existing communication link 200 may, for example, consist of conveying as part of the further communication that the two vehicles 11 and 12 are coupled to one other; before establishing the coupling state, it can be conveyed, for example, that the vehicles 11 and 12 are not coupled to one other.

In order to prevent the wayside switching device 20 from connecting vehicles which have not actually been coupled together but have merely transmitted configuration signals A to the switching device 20 shortly after one another, it is considered advantageous if the switching device 20 establishes the communication link 200 between the vehicles 11 and 12 only if it receives the communication signals A of the two vehicles 11 and 12 within a predetermined, preferably relatively brief, time period. The time period is preferably no more than one second.

Figure 3:
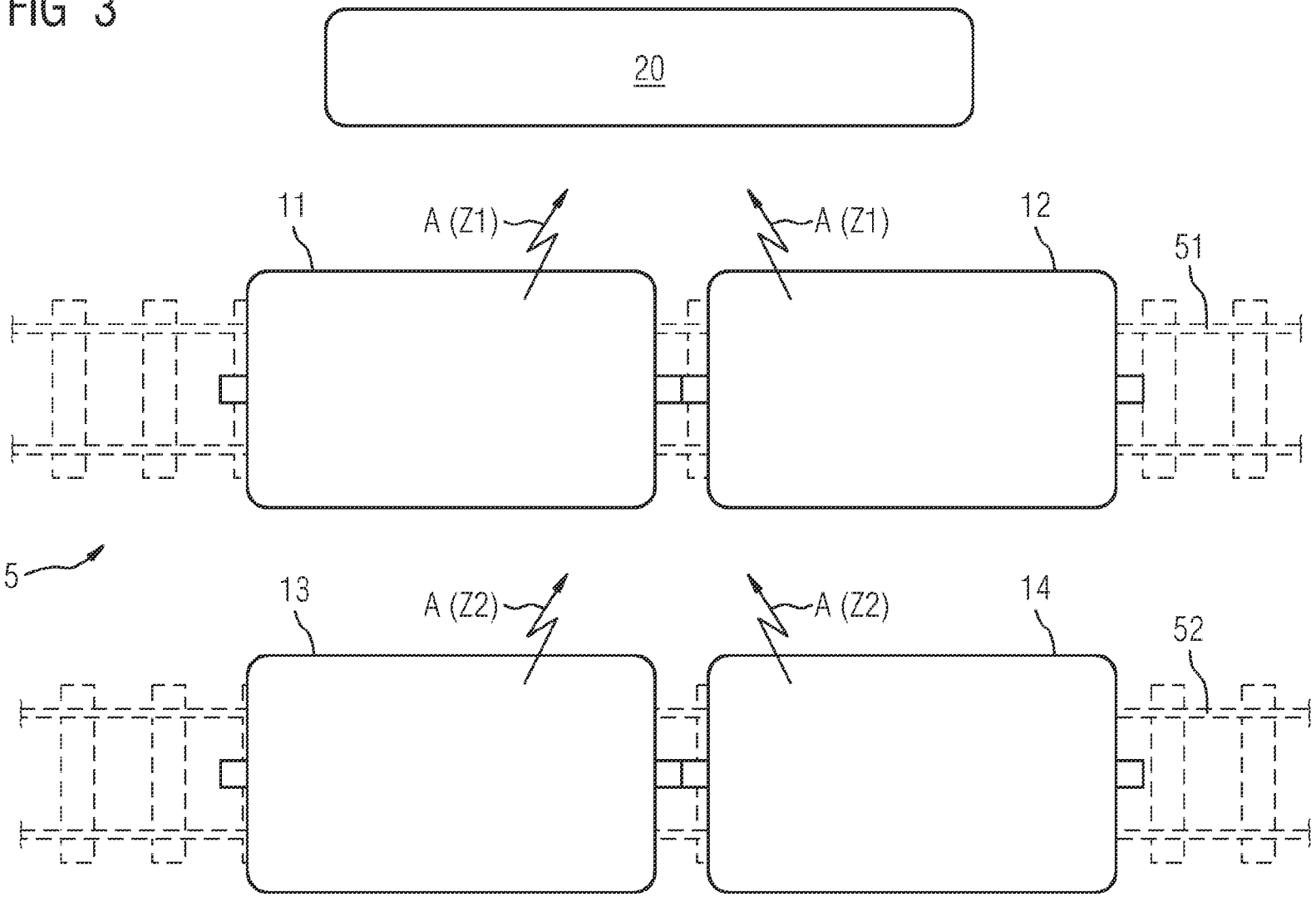
FIG. 3 shows another exemplary embodiment of a line system with reference to which another exemplary embodiment of the method according to the invention will be described, wherein in the method according to FIG. 3 communication signals containing destination information are transmitted.

FIG. 3 shows an exemplary embodiment of a line system 5 comprising two tracks 51 and 52. The upper track 51 in FIG. 3 is used by two vehicles 11 and 12; the lower track 52 in FIG. 3 is used by two vehicles 13 and 14.

In the following, it will be assumed by way of example that the vehicles 11 and 12 on the track 51 are coupled together as explained in connection with FIGS. 1 and 2 above. In addition, it is assumed by way of example that the two vehicles 13 and 14 on the lower track 52 are likewise coupled together at the same time or at least shortly before or after the coupling of the vehicles 11 and 12.

Because of the simultaneous or chronologically proximate coupling of vehicles 11 and 12 on the one hand and 13 and 14 on the other, the situation now arises that the wayside switching device 20 receives configuration signals A simultaneously or at almost the same time from a total of four vehicles, namely from the vehicles 11, 12, 13 and 14. The wayside switching device 20 is therefore unable to determine unequivocally which of the vehicles 11 to 14 has to be connected to which other vehicle in terms of communication.

In order to solve this problem, according to the method variant shown in FIG. 3, destination information ZI or Z2, as the case may be, is transmitted from the vehicles 11 to 14 to the wayside switching device 20 along with the configuration signals A. The destination information ZI can indicate, for example, that the vehicles 11 and 12 will be traveling to Hamburg, whereas the destination information Z2 indicates that the vehicles 13 and 14 will be traveling to Munich.

On the basis of the destination information ZI and Z2, the switching device 20 can now determine that the vehicles 11 and 12 must be linked together in terms of communication and the vehicles 13 and 14 likewise. A wrong communication link between individual vehicles can be easily prevented by the additional transmission of the destination information ZI and Z2.

Instead of or in addition to destination information ZI and Z2 indicating the respective destination, route information can also be transmitted which describes the respective route and thus indicates whether the vehicles will be traveling over at least one common route section.

Figure 4:
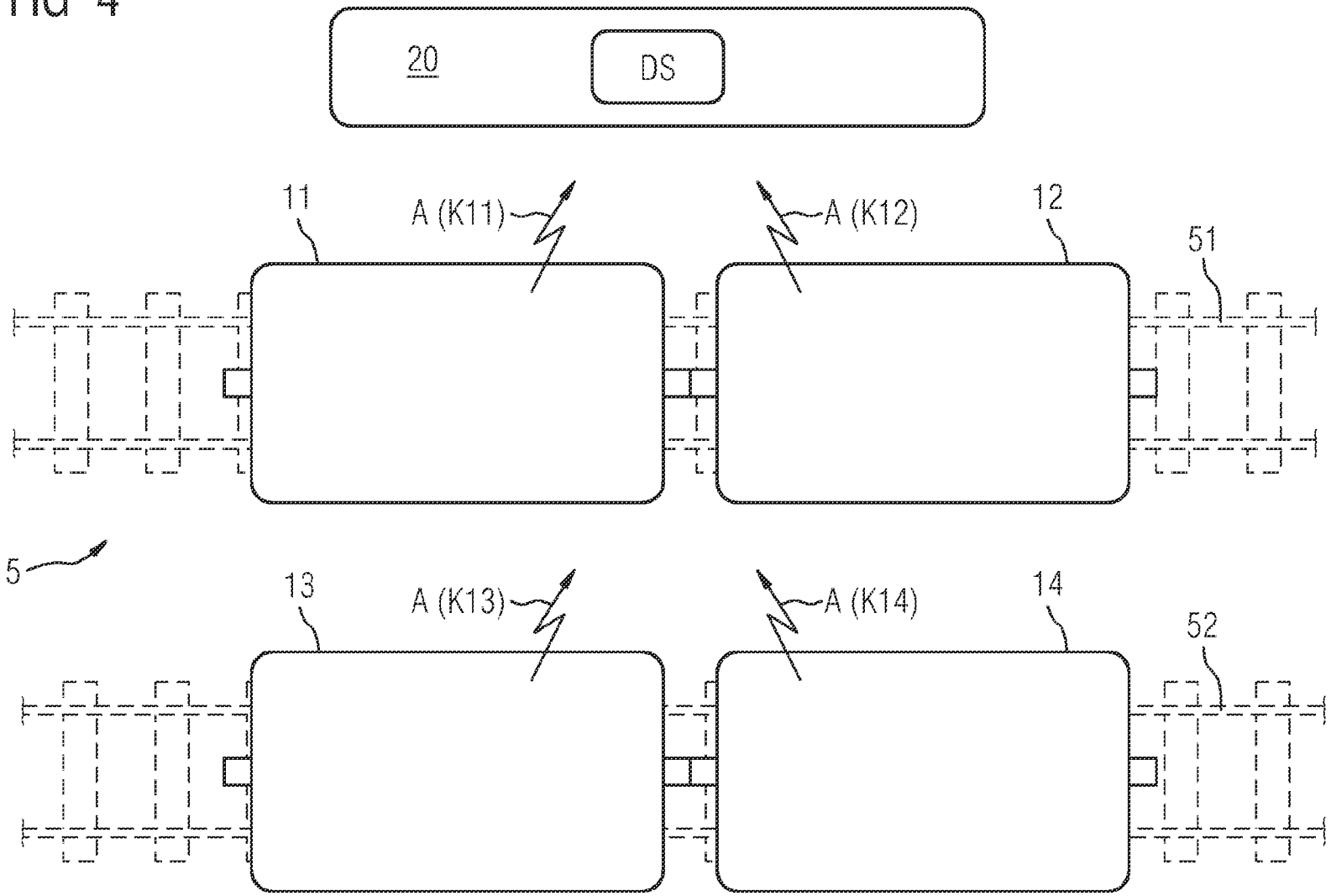
FIG. 4 shows another exemplary embodiment of a line system with reference to which another exemplary embodiment of the method according to the invention will be described, wherein in the method according to FIG. 4 communication signals containing vehicle identification codes are transmitted.

FIG. 4 shows an exemplary embodiment of a line system 5 in which—in conformity with the line system in FIG. 3—two tracks 51 and 52 are used by two vehicles 11 and 12 and 13 and 14 in each case. Also in conformity with the exemplary embodiment shown in FIG. 3, it is assumed in the exemplary embodiment shown in FIG. 4 that coupling of the vehicles 11 and 12 and of the vehicles 13 and 14 takes place simultaneously or one shortly after the other.

After being coupled to another vehicle, the vehicles 11 to 14 transmit a configuration signal A in each case indicating the respective identification code of the individual vehicle in order to enable the wayside switching device 20 to establish correct communication links between the vehicles. In the exemplary embodiment shown in FIG. 4, the identification code K11 identifies the vehicle 11, the identification code K12 identifies the vehicle 12, the identification code K13 identifies the vehicle 13, and the identification code K14 identifies the vehicle 14.

Stored in the wayside switching device 20 is a data set DS which indicates which vehicles can or are to be coupled together and which not. For example, the data set DS may store the fact that the vehicles 11 and 12 can be coupled together, but not the vehicles 11 and 13 or 11 and 14. In addition, it can be stored that the vehicle 13 can be coupled to the vehicle 14, but not to the vehicles 11 and 12. Accordingly, by evaluation of the data set DS by the switching device 20, it can be determined that a communication link between the vehicles 11 and 12 and a communication link between the vehicles 13 and 14 must be established. This prevents incorrect communications linking of vehicles.

Figure 5:
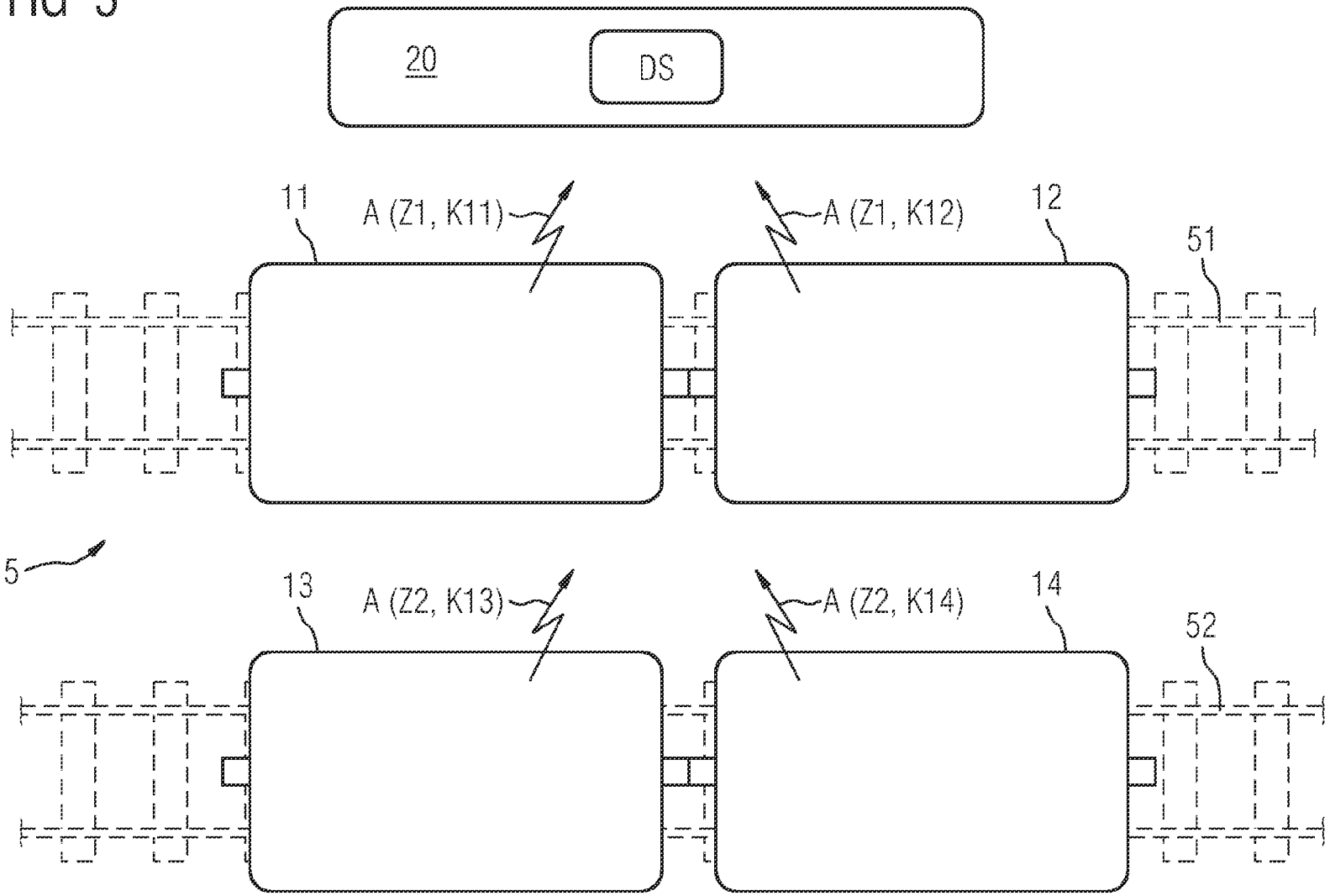
FIG. 5 shows another exemplary embodiment of a line system with reference to which another exemplary embodiment of the method according to the invention will be described, wherein in the method according to FIG. 5 communication signals containing destination information and vehicle identification codes are transmitted.

FIG. 5 shows a line system 5 in which the vehicles 11 to 14 transmit to the wayside switching device 20 both destination information ZI and Z2, as explained in connection with FIG. 3, and identification codes K11 to K14, as explained in connection with the exemplary embodiment in FIG. 4.

By evaluating the destination information ZI and Z2 as well as the identification codes K11 to K14, the wayside switching device 20 is thus able to determine particularly safely and reliably between which of the vehicles 11 to 14 communication links are or are not to be established; in this regard, the above statements in connection with FIGS. 3 and 4 are incorporated by reference herein.

Figure 6:
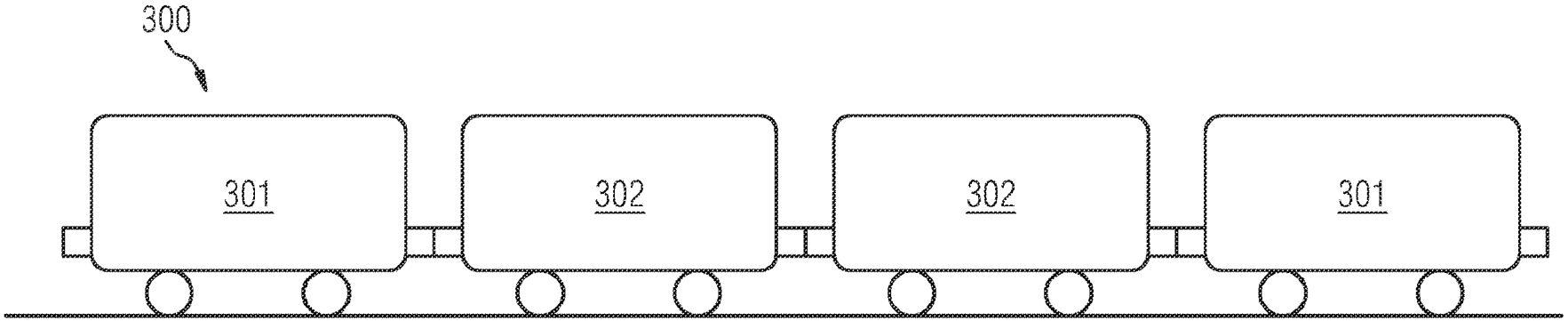
FIG. 6 shows an exemplary embodiment of a vehicle according to the invention that is multi-section and consists of powered and non-powered individual vehicles.

FIG. 6 shows an exemplary embodiment of a vehicle 300 which can be used as vehicle 11 or 12 according to FIGS. 1 to 5 and as vehicle 13 and 14 according to FIGS. 3 to 5.

The vehicle 300 has powered individual vehicles 301 and non-powered individual vehicles 302. The powered individual vehicles 301 can be locomotives, for example, and the non-powered individual vehicles 302 can be railroad cars.

Figure 7:
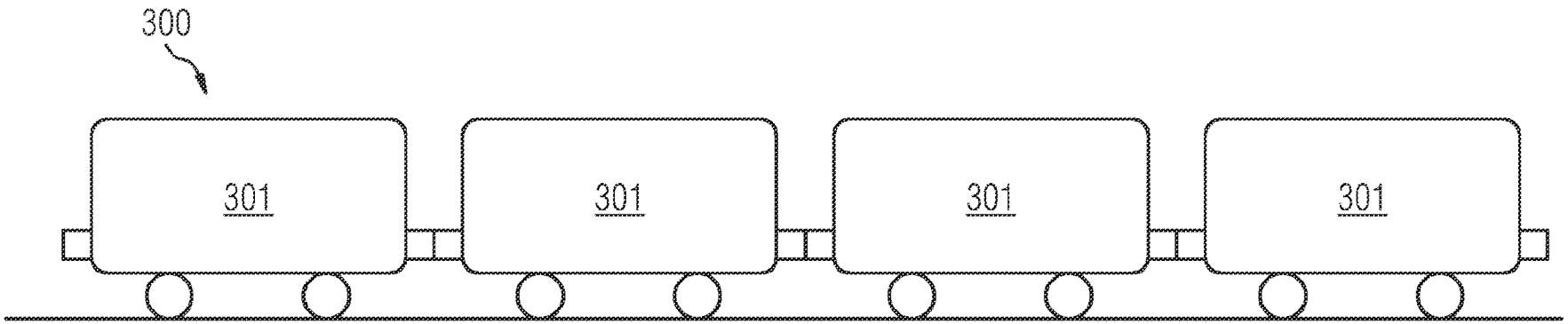
FIG. 7 shows another exemplary embodiment of a vehicle according to the invention, which consists exclusively of powered individual vehicles.

FIG. 7 shows another exemplary embodiment of a vehicle 300 which can be used as a vehicle 11 or 12 in the exemplary embodiments shown in FIGS. 1 to 5 or as a vehicle 13 or 14 in the exemplary embodiments shown in FIGS. 3 to 5. In contrast to the exemplary embodiment in FIG. 6, the vehicle 300 in FIG. 7 consists exclusively of powered individual vehicles 301. The vehicle 300 can be, for example, a local train, e.g. a subway train or a suburban train.

Figure 8:
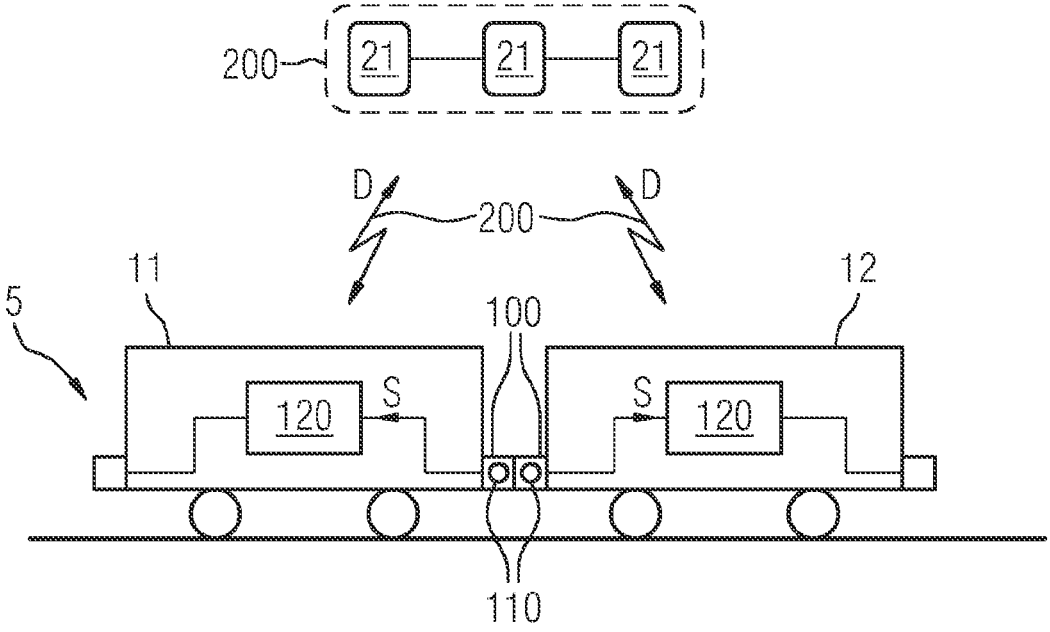
FIG. 8 shows another exemplary embodiment of a line system with reference to which another exemplary embodiment of the method according to the invention will be described, wherein in the line system according to FIG. 8 the communication link between two vehicles is operated with the inclusion of two or more wayside access devices of the wayside switching device.

FIG. 8 shows a line system 5, the wayside switching device 20 of which has a plurality of wayside access devices 21. The communication link between two vehicles 11 and 12 is possibly operated, i.e. established and/or maintained, with the inclusion of two or more wayside access devices 21 of the wayside switching device 20. The data signals D of the two vehicles 11 and 12 can be routed via one single access device 21 or via a plurality of access devices 21, wherein in the latter case the data signals D are routed from access device to access device.

Although the invention has been illustrated and described in detail by preferred exemplary embodiments, the invention is not limited by the examples disclosed and other variations will be apparent to persons skilled in the art without departing from the scope of protection of the invention.

LIST OF REFERENCE CHARACTERS

5 line system
11 vehicle
12 vehicle
13 vehicle
14 vehicle
20 switching device
21 access device
51 track
52 track
100 coupling device
110 sensor device
120 communication device
200 communication link
300 vehicle
301 individual vehicle
302 individual vehicle
A configuration signal
D data signal
DS data set
K11 identification code
K12 identification code
K13 identification code
K14 identification code
S sensor signal
ZI destination information
Z2 destination information

The invention claimed is:

1. A method for operating a first and a second vehicle, which comprises the steps of:

performing a check on board each of the first and second vehicles to ascertain whether a new coupling to another vehicle has taken place, and if the new coupling is detected, a configuration signal indicating a coupled state is transmitted to a wayside switching device in each case; and establishing a communication link between the first and second vehicles with an inclusion of the wayside switching device, or an already existing communication link between the first and second vehicles is reconfigured if the configuration signal of the first vehicle and the configuration signal of the second vehicle are present.

2. The method according to claim 1, wherein the communication link is only established or reconfigured if the two configuration signals are received within a specified time period.

3. The method according to claim 1, wherein:

on detecting the new coupling, the first vehicle transmits to the wayside switching device a first configuration signal containing route information relating to the first vehicle and/or an identification code identifying the first vehicle;

on detecting the new coupling, the second vehicle transmits to the wayside switching device a second configuration signal containing route information relating to the second vehicle and/or an identification code identifying the second vehicle; and a check is performed on board the first vehicle and/or the second vehicle and/or trackside to ascertain whether coupling of the first and second vehicles is confirmed.

4. The method according to claim 3, which further comprises establishing the communication link between the first and second vehicles by the wayside switching device only if identification codes of the first and second vehicles indicate that the first and second vehicles are vehicles to be coupled or capable of being coupled to each other according to a predefined data set, and/or the route information of the first and second vehicles indicates that they have a same destination or will be traveling over at least one common route section.

5. The method according to claim 1, which further comprises:

performing a check on board each of the first and second vehicles to ascertain whether an existing coupling to a respective other vehicle has been released; and clearing down the communication link between the first and second vehicles by at least one of the first and second vehicles or from the wayside switching device on detection of an uncoupling.

6. The method according to claim 1, which further comprises:

checking and detecting the coupled state by a sensor device of the first vehicle and a sensor device of the second vehicle;

on detecting the coupled state, switching the sensor device of the first vehicle from a first sensor status indicating an uncoupled state, to a second sensor status indicating a coupled state, and, after switchover from the first sensor status to the second sensor status, a communication device of the first vehicle connected to the sensor device of the first vehicle sends the configuration signal to the wayside switching device; and on detecting the coupled state, switching the sensor device of the second vehicle from a first sensor status indicating an uncoupled state, to a second sensor status indicating a coupled state, and, after switchover from the first sensor status to the second sensor status, a communication device of the second vehicle connected to the sensor device of the second vehicle sends the configuration signal to the wayside switching device.

7. The method according to claim 1, wherein at least one of the first and second vehicles is multi-section and is constituted by at least two individual vehicles which are connected to one another and are powered or non-powered.

8. The method according to claim 1, wherein the first and second vehicles are rail vehicles.

9. A vehicle for operating a communication link with a further vehicle, the vehicle comprising:

a coupling device for establishing a coupled state with the further vehicle;

a sensor device configured to determine whether said coupling device is in the coupled state or an uncoupled state; and a communication device connected to said sensor device, and on detection of a transition from the uncoupled state to the coupled state, said communication device transmits a configuration signal indicating the coupled state to a wayside switching device, said communication device being configured for having a communication link with a communication device of the further vehicle based upon the coupled state, the communication link being via the wayside switching device.

10. The vehicle according to claim 9, wherein said sensor device has an electrical switching contact and said electrical switching contact has a different contact position in the coupled state of the vehicle compared to the uncoupled state.

11. A line system, comprising:

a wayside switching device which can communicate with vehicles running on the line system, said wayside switching device having received a first configuration signal indicating a coupling state of a first vehicle with respect to another vehicle and having received a second configuration signal indicating a coupling state of a second vehicle with respect to another vehicle is configured to establish a communication link between the first and second vehicles or to reconfigure an already existing communication link between the first and second vehicles.

12. The line system according to claim 11, wherein said wayside switching device is configured to interconnect the first and second vehicles only if said wayside switching device receives the first and second configuration signal within a predetermined time period.

13. The line system according to claim 12, wherein said wayside switching device has at least two wayside access devices which are interconnected and each capable of communicating with at least one vehicle and configured to operate the communication link between the first and second vehicles with an inclusion of said at least two wayside access devices.

14. The line system according to claim 11, wherein on receiving two configuration signals, said wayside switching device checks whether coupling of the first and second vehicles sending the configuration signals is confirmed.

15. The line system according to claim 11, wherein:

said wayside switching device establishes the communication link between the first and second vehicles only if vehicle identification codes indicate that the first and second vehicles are vehicles to be coupled or capable of being coupled to one other according to a predefined data set, and/or route information of the first and second vehicles indicates that they have a same destination or will be traveling over at least one common route section; and/or said wayside switching device clears down the communication link if at least one of the first and second vehicles indicates uncoupling of the first and second vehicles.

* * * * *